US010449983B2

(12) United States Patent
Lozano-Ovejero et al.

(10) Patent No.: US 10,449,983 B2
(45) Date of Patent: Oct. 22, 2019

(54) METHOD FOR COMMANDING A RAILWAY LEVEL CROSSING PROTECTION SYSTEM

(71) Applicant: ALSTOM TRANSPORT TECHNOLOGIES, Saint-Ouen (FR)

(72) Inventors: Alfonso Matias Lozano-Ovejero, Madrid (ES); Oscar Martin-Blasco, Leganes (ES)

(73) Assignee: Alstom Transport Technologies, Saint-Ouen (FR)

( * ) Notice: Subject to any disclaimer, the term of this patent is extended or adjusted under 35 U.S.C. 154(b) by 250 days.

(21) Appl. No.: 15/475,710

(22) Filed: Mar. 31, 2017

(65) Prior Publication Data

US 2017/0282946 A1 Oct. 5, 2017

(30) Foreign Application Priority Data

Apr. 5, 2016 (EP) ..... 16305392

(51) Int. Cl.

| | |
|---|---|
| ***B61L 29/30*** | (2006.01) |
| ***B61L 7/06*** | (2006.01) |
| ***B61L 7/08*** | (2006.01) |
| ***B61L 23/14*** | (2006.01) |
| ***B61L 25/02*** | (2006.01) |
| ***B61L 29/22*** | (2006.01) |

(52) U.S. Cl.

CPC ..... *B61L 29/30* (2013.01); *B61L 7/06* (2013.01); *B61L 7/08* (2013.01); *B61L 23/14* (2013.01); *B61L 25/021* (2013.01); *B61L 25/025* (2013.01); *B61L 29/22* (2013.01); *B61L 2201/00* (2013.01)

(58) Field of Classification Search

CPC ..... B61L 11/00; B61L 11/08; B61L 13/00; B61L 13/04; B61L 19/00; B61L 29/00; B61L 29/08; B61L 29/18; B61L 29/22; B61L 29/24; B61L 29/30; B61L 29/32

See application file for complete search history.

(56) References Cited

U.S. PATENT DOCUMENTS

| | | | |
|---|---|---|---|
| 3,660,652 A | 5/1972 | Staples et al. | |
| 2002/0096605 A1 | 7/2002 | Berry et al. | |
| 2011/0133038 A1* | 6/2011 | Kiss, Jr. ..... | B61L 29/24 246/126 |

FOREIGN PATENT DOCUMENTS

WO 2009/100292 A1 8/2009

OTHER PUBLICATIONS

Extended European Search Report for EP Application 16305392.9 dated Sep. 30, 2016.

* cited by examiner

*Primary Examiner* — Robert J McCarry, Jr.
(74) *Attorney, Agent, or Firm* — Thompson Coburn LLP

(57) ABSTRACT

A method for commanding a railway level crossing protection system comprising: a) activating a railway signal preventing a train from driving beyond a level crossing; b) detecting an incoming train approaching the level crossing and measuring a speed of said incoming train; c) calculating a waiting time, as a function of the train's measured speed; d) waiting until expiration of the calculated waiting time and, once said waiting time expires, sending an order to commute the protection system into the protected state; and e) querying the state of the protection system and if said protection system is found to have commuted into the protected state, deactivating said railway signal, and maintaining said railway signal in the activated state otherwise.

9 Claims, 8 Drawing Sheets

METHOD FOR COMMANDING A RAILWAY LEVEL CROSSING PROTECTION SYSTEM

CROSS-REFERENCE TO RELATED APPLICATIONS

This application claims the benefit of European Patent Application EP 16305392.9, filed Apr. 5, 2016, which is incorporated herein by reference in its entirety.

FIELD OF THE INVENTION

The invention relates to a method for commanding a railway level crossing protection system. The invention also relates to an electronic calculator programmed to implement such a method and also relates to a railway interlocking facility comprising said electronic calculator.

BACKGROUND OF INVENTION

In railway technology, level crossings are known, in which a railroad including a railway track crosses, at a same level on the ground, a road dedicated to ground vehicles such as cars and/or pedestrians. Such level crossings are often equipped with protection systems, comprising warning signals that can be selectively activated whenever a train is approaching. This way, vehicles and pedestrians coming from the road are prevented from crossing the railway track until the train has passed. Such protection systems are typically commanded by a central interlocking facility, which activates them whenever it detects an incoming train. It is highly desirable that such level crossing systems remain in a closed state for a duration as short as possible, e.g. that the level crossing protection time is as low as possible, in order not to disrupt traffic on the road.

One such method is known of US 2011/0133038 A1, in which, whenever an incoming train is detected approaching a level crossing, the interlocking facility waits for a certain amount of time before initiating the closure of the barriers of the protection system. This amount of time is calculated as a function of the incoming train's speed, as measured by trackside equipment. Taking account of the train's speed avoids closing the barriers too early, for example when the train is moving slowly and still far away from the level crossing.

A drawback of this known method is that measurement of the train's speed does not take into consideration that the train may slow down or accelerate during the measurement. It does not take either into consideration that the measurement takes time, not only due to the time required for averaging the measured speed, but also due to the propagation time of data between the train, the trackside equipment and the interlocking facility. This lack of precision has the consequence that the level crossing may remain closed for much longer than necessary, causing unwanted disruption to the traffic on the road.

SUMMARY OF THE INVENTION

The object of the present invention is therefore to provide an optimized method for commanding a level crossing railway protection system, in which the protection system remains closed for as little time as possible, without compromising the safety of the railway line.

To that end, the invention relates to a method for commanding a railway level crossing protection system, said protection system equipping a level crossing between a railway track and a road and being able to switch selectively between a protected state, in which road vehicles on said road are prohibited from crossing the railway track, and an unprotected state, in which said road vehicles may cross the railway track, the level crossing protection system initially being in the unprotected state, this method comprising steps of automatically:

a) activating a railway signal preventing a train from driving beyond the level crossing, b) detecting an incoming train approaching the level crossing and measuring a speed of said incoming train, c) calculating a waiting time, as a function of the train's measured speed;

d) waiting until expiration of the calculated waiting time and, once said waiting time has expired, sending an order to switch the level crossing protection system into the protected state;

e) querying the state of the level crossing protection system and:

if said level crossing protection system is found to have commuted into the protected state, deactivating said railway signal, thus allowing the train to drive beyond the level crossing, and otherwise; and if said level crossing protection system is found to be still in the unprotected state, maintaining said railway signal in the activated state;

wherein calculation of the waiting time comprises steps of:

acquiring reference data comprising a plurality of speed value intervals each associated to a predefined waiting time value, and selecting the speed value interval corresponding to the measured speed value, selecting the predefined waiting time value associated to the selected speed value interval.

According to advantageous aspects, the invention comprises one or more of the following features, considered alone or according to all possible technical combinations:

the number of speed values intervals of the reference data is comprised between 2 and 50;

deactivation of the railway signal comprises updating a Movement Authority of the train by moving the end point of the Movement Authority beyond the level crossing;

the railway signal is according to ETCS Level 2 specifications, said railway signal being transmitted to the train using a radio block center;

the method includes further, during step b), after detecting the train, sending a temporary speed restriction to the detected incoming train; and the railway signal is according to ETCS Level 1 specifications, said railway signal being transmitted to the train using a beacon through a lineside encoder unit or radio in-fill device.

According to another aspect, the invention relates to a data storage unit, comprising instructions for implementing a method according to the invention when said instructions are executed by a data processing unit.

According to another aspect, the invention relates to a data processing unit for an electronic calculator of a railway interlocking facility configured to command a railway level crossing protection system equipping a level crossing between a railway track and a road, said protection system being able to switch selectively between a protected state, in which road vehicles on said road are prohibited from crossing the railway track, and an unprotected state, in which said road vehicles may cross the railway track, the level crossing protection system initially being in the unprotected state, said calculator being programmed to:

a) activate a railway signal preventing a train from driving beyond the level crossing, b) detect an incoming train approaching the level crossing and measuring a speed of said incoming train, c) calculate a waiting time, as a function of the train's measured speed;

d) wait until expiration of the calculated waiting time and, once said waiting time expires, sending an order to commute the level crossing protection system into the protected state;

e) query the state of the level crossing protection system and:

if said level crossing protection system is found to have commuted into the protected state, deactivate said railway signal, thus allowing the train to drive beyond the level crossing; and if said level crossing protection system is found to be still in the unprotected state, maintain said railway signal in the activated state;

wherein said data processing unit is further programmed to, during step c) of calculation of the waiting time:

acquire reference data comprising a plurality of speed value intervals each associated to a predefined waiting time value;

select the speed value interval corresponding to the measured speed value; and select the predefined waiting time value associated to the selected speed value interval.

According to another aspect, the invention relates to a railway interlocking facility, adapted to command a level crossing protection system, wherein said railway interlocking facility comprises a data processing unit and the data storage unit according to the invention in order to command said level crossing protection system.

BRIEF DESCRIPTION OF THE DRAWINGS

The invention will be better understood upon reading the following description, provided solely as an example, and done in reference to the appended drawings.

DETAILED DESCRIPTION OF THE INVENTION

Figure 1:
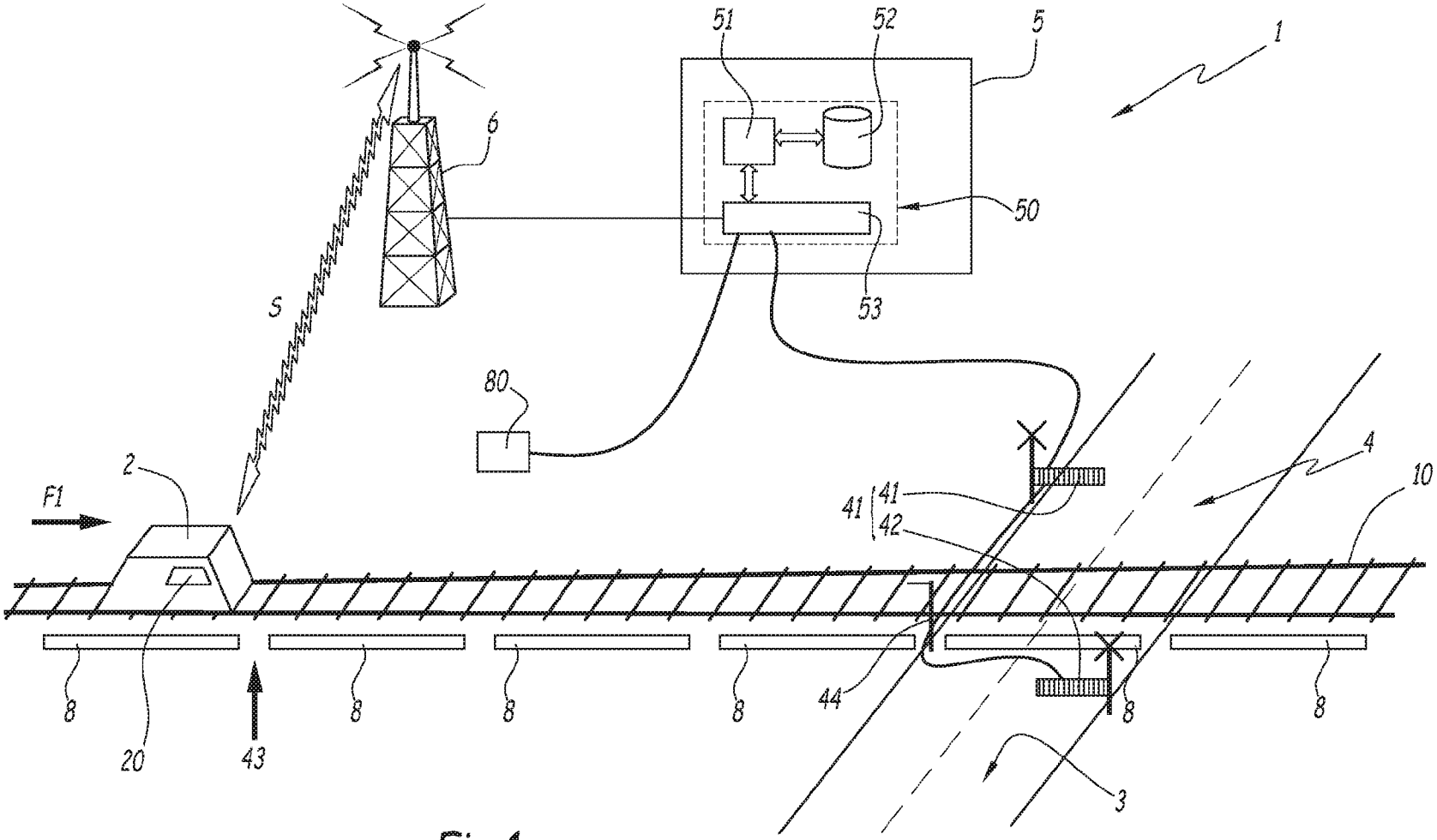
FIGS. 1 and 2 illustrate schematically a portion of a railway system comprising a level crossing protection system and an interlocking facility, according to two embodiments of the invention.

FIG. 1 illustrates a portion of a railway system 1, which comprises a railway track 10 on which a rail vehicle 2 is running and a level crossing 4.

In this example, rail vehicle 2 is a passenger train, such as an electrical multiple unit, which comprises electric motors configured to move said train 2 along railway track 10. To this end, railway system 1 comprises an electrical power distribution system including an overhead line, not illustrated, able to provide electric power to the train 2.

Train 2 also comprises an onboard control unit 20, described in greater detail in what follows.

Level crossing 4 is located at an intersection between railway track 10 and a road 4 dedicated to motor ground vehicles such as cars. Road 4 and railway track 10 cross each other at a same level on the ground.

In this example, train 2 is moving towards level crossing 4 along railway track 10 in a forward direction illustrated on FIG. 1 by arrow F1. In what follows, "ahead" is defined with respect to this forward direction.

System 1 comprises a protection system 41 equipping level crossing 4, whose role is to prevent cars driving on road 3 from crossing railway track 10 when a train 2 is approaching, in order to prevent unwanted collisions. To this end, level crossing protection system 41 is equipped with warning signals, such as barriers 42 and/or flashing lights to warn users of road 3.

Protection system 41 is selectively and reversibly switchable between a protected state and an unprotected state. In the protected state, protection system 41 prevents cars from crossing railway track 10. For example, barriers 42 close at least a portion of road 3 and flashing lights are activated. In the unprotected state, protection system 41 allows cars to freely cross railway track 10. For example, barriers 42 are open and flashing lights are deactivated.

Reference 43 denotes an activation point of level crossing 4 and reference 44 points to the beginning of level crossing 4.

Activation point 43 is located ahead of level crossing 4 at a distance higher than train braking distance at maximum speed, for example 700 meters ahead of level crossing 4. The exact location of activation location point 43 is usually chosen during installation of system 1, depending on specific constraints of railway track 10 and/or the expected speed of trains on this portion of railway track 10. Train 2 is said to be approaching level crossing 4 when it has passed beyond said point 43. In a normal operation mode, protection system 41 can be switched into its protected state after train 2 has passed point 43, but necessarily before train 2 arrives at point 44, and taking into account that the protection of the level crossing in general takes a significant amount of time, for example 30 seconds.

Point 44 is placed shortly ahead of level crossing 4, for example no further than 50 meters or 100 meters of the edge of road 3. In a normal operation mode, protection system 41 must be in its protected state when train 2 arrives at point 44, for an amount of time defined by the system. If protection system 41 is not in its protected state by then, train 2 must be stopped before point 44 to prevent unwanted collision with road vehicles on road 3. For example, train 2 is stopped by means of an appropriate railway signal S, as described in what follows.

System 1 also comprises an interlocking facility 5, configured to control railway signals and equipment of system 1, in order to ensure adequate movement of train 2 along a predetermined itinerary along railway track 10.

Interlocking 5 is configured to control protection system 41 when train 2 is coming towards level crossing 4. Interlocking facility 5 is also configured to manage railway signals of system 1 in order to regulate the movement of train 2 along railway track 10. More specifically, interlocking facility 5 is configured to detect when train 2 passes over activation point 44.

In this example, interlocking 5 is able to interface with ERTMS technology standards, for "European Rail Traffic Management System". Railway signals S are sent by interlocking 5 and transmitted to train 2 using a signaling system according to ETCS specifications, for "European Train Control System".

In this embodiment, interlocking 5 is compliant with ERTMS ETCS Level 2 technology. Railway signals are transmitted to train 2 by means of a radio link, using a communication technology such as GSM-R or LTE. To this end, system 1 includes a Radio Block Center, noted RBC 6 connected with interlocking 5.

Control unit 20 is programmed to regulate the speed V of train 2 based on signal S received from RBC 6, which receives correspondingly the information from the interlocking 5. For example, control unit 20 contains an electronic calculator known as an ETCS-compliant "European Vital Computer", abbreviated EVC. Control unit 20 is configured to implement security functions known as "Automatic Train Protection", abbreviated ATP, and/or "Automatic Train Control", abbreviated ATC. Such security systems and such an electronic calculator are well known and are not described in further details.

In this description, speed V is lower than or equal to the maximum speed allowed on the line or the maximum speed of the train.

Interlocking facility 5 comprises an electronic calculator 50 programmed to automatically operate interlocking 5. Calculator 50 includes data processing unit 51, data storage unit 52 and data exchange interface 53. Data storage unit 52 contains instructions for implementing the method of FIG. 6 for commanding protection system 41, when said instructions are executed by data processing unit 51. Data storage unit 52 is a computer memory, such as a hard drive or a data base. Data processing unit 51 comprises a programmable microprocessor. Data exchange interface 53 allows receiving and transmitting data and instructions to and from interlocking facility 5. Data processing unit 51, data storage unit 52 and data exchange interface 53 are linked together by a communication bus.

Interlocking 5 is able to command the switching of protection system 41 between its protected and unprotected states, for example by sending a command instruction to protection system 41 using a communication link, such as a cable extending between protection system 41 and data exchange interface 53.

Interlocking 5 is also able to query the state in which protection system 41 is at any given instant, and so can detect if protection system 41 fails to switch into the protected state despite being commanded to do so. In this example, in the event of such a failure, train 2 is prevented to move beyond point 44 thanks to signal S. For example, protection system 41 includes position sensors that monitor the actual position of barriers 42 to determine whether barriers 42 are closed or open.

Interlocking 5 is further configured to monitor the location of train 2 along railway 10 and to measure the speed V of train 2, especially so as to detect when train 2 passes activation point 43.

In this example, railway track 10 is equipped with a plurality of track circuits 8, placed regularly and continuously along railway track 10. As is known, each track circuit 8 is associated to a fixed-length portion of railway track 10 and is configured to measure the occupancy status of said portion of railway track 10 by train 2. Each track circuit 8 has a length superior or equal to 100 meters, preferably superior or equal to 500 meters, so as to allow the train identification within the selected interval with good accuracy, for example of 1 kilometer per hour.

Whenever train 2 enters inside a portion of railway track 10 associated to a given track circuit 8, said track circuit 8 is activated and emits an activation signal. Said activation signal is forwarded to interlocking 5. For example, it is forwarded to a data concentrator 80 connected to said track circuit 8 and also connected, by means of a communication link, such as a cable, to data exchange interface 53. Whenever train 2 leaves said portion of railway track 10, the corresponding track circuit 8 is no longer activated and no activation signal is emitted.

Speed V is calculated using occupancy status data provided by track circuits 8. For example, the time difference between the moment when train 2 enters inside a given track circuit, and the following moment when train 2 leaves this same track circuit 8, is measured. Speed V is then automatically calculated by knowing the length of the track circuit 8 and by knowing physical parameters of train 2, such as its length and/or its number of axles. In this example, this speed measurement is performed using the track circuit 8 on which activation point 43 is located.

Figure 2:
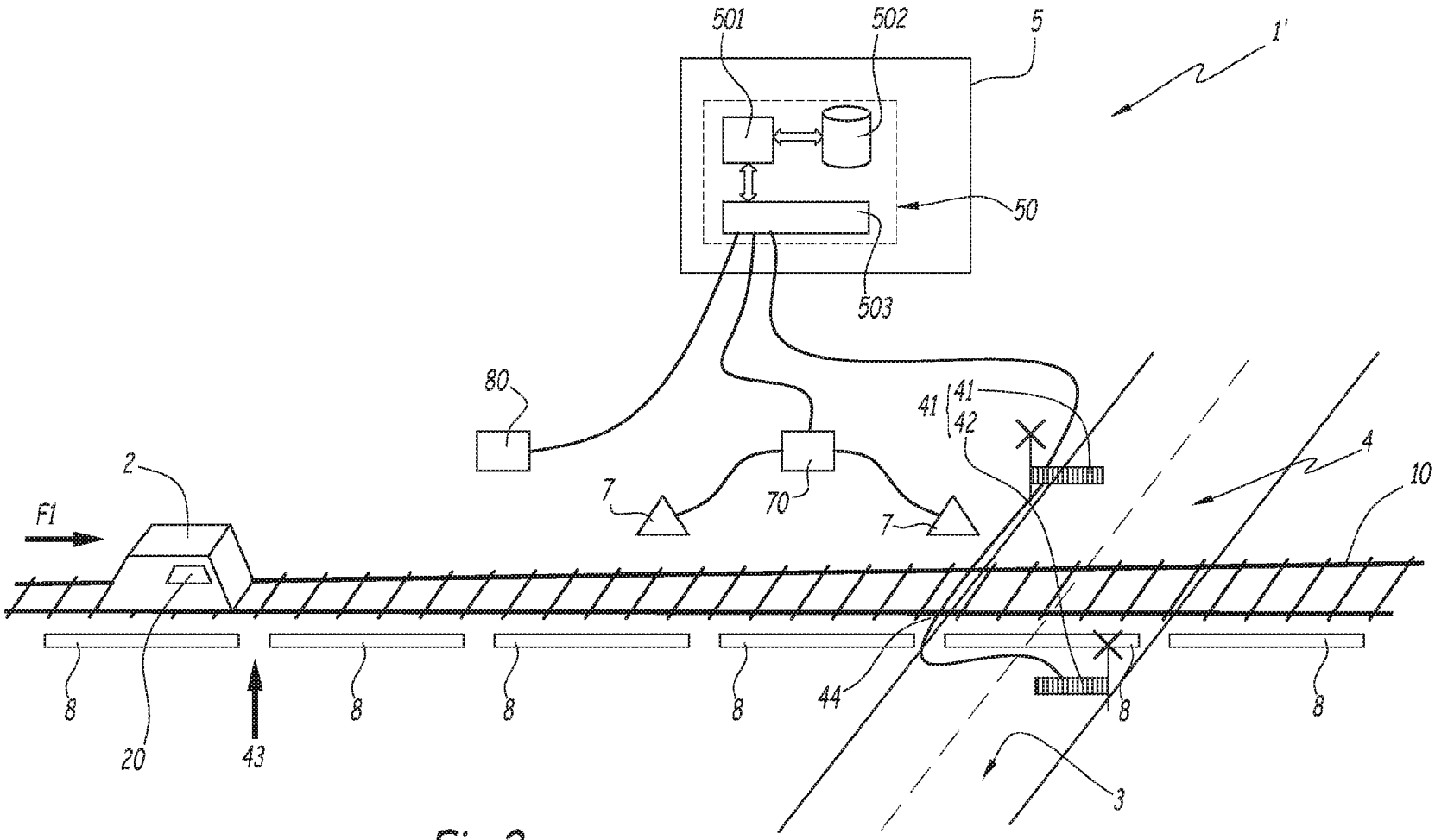

FIG. 2 illustrates a railway system 1' which is another embodiment of system 1, advantageously adapted to ERTMS ETCS Level 1 systems. In FIG. 2, elements bearing the same reference number as elements of FIG. 1 are identical to the elements of the embodiment of FIG. 1 and are not described in further detail. What is described in reference to system 1 applies to system 1'. In such ETCS Level 1 systems, railway signals are transmitted to train 2 by means of a Lineside Encoder Unit, abbreviated LEU, or radio in-fill device connected to beacons placed along or beneath railway track 10, instead of being transmitted by a RBC through a long-range radio link such as GSM-R or LTE. To this end, system 1' is identical to system 1, except that radio block center 6 is replaced by at least one LEU or radio in-infill device and one beacon 7. Beacon 7 is able to transmit data to train 2, by means of a LEU or radio in-infill device and one, when train 2 is located near said beacon 7. For example, each beacon 7 includes a transponder inductively coupled to a corresponding transponder unit located inside train 2. In the illustrative example of FIG. 2, radio block center 6 is replaced by a plurality of beacons 7 each connected to a LEU 70, itself connected to interface 53.

In both systems 1 and 1', interlocking 5 is also configured to minimize the duration in which protection system 41 remains in the protected state when train 2 is detected, without compromising the safety of level crossing 4. The duration in which protection system 41 remains in the protected state is noted as protection time T. In this description, protection time T begins from the moment interlocking 5 sends a command to close protection system 41, that is to say, to switch protection system 41 into its protected state and ends once the train has reached the level crossing.

The maximum value of protection time T to be chosen depends on safety requirements and traffic levels of road 3. As an illustrative example, when a single train 2 is coming, protection time T should not be preferably higher than two minutes and not lesser than 30 seconds.

In order to minimize protection time T, a variable waiting time $t_D$ is introduced between the moment interlocking 5 detects that train 2 has passed activation point 43, and the moment when interlocking 5 sends a command to close protection system 41. Waiting time $t_D$ is calculated by calculator 50 for each train 2, as a function of the speed V of said train 2. In this example, this calculation is performed by selecting, from a predefined acquired reference data set, a corresponding waiting time $t_D$ associated to measured speed V. This reference data may be acquired for each train, or in another embodiment, acquired once by calculator 50 of interlocking 5.

Figure 3:
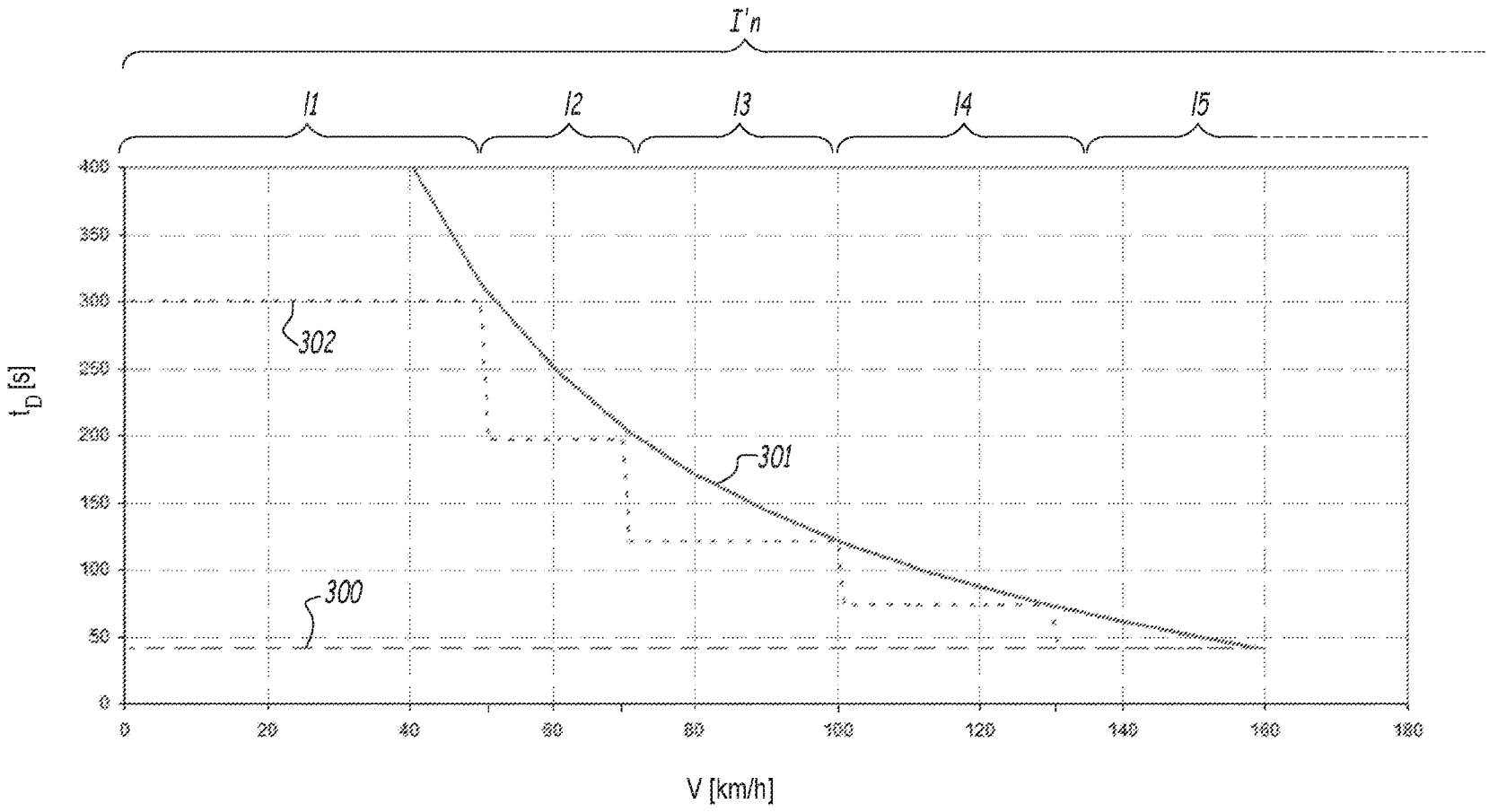
FIG. 3 illustrates the evolution, as a function of the train's speed, of several values of a waiting time as calculated by the interlocking facility of FIGS. 1 and 2.

FIG. 3 illustrates several examples of data reference set in which waiting time $t_D$, in seconds, is expressed as a function of speed V, in kilometers per hour.

Figure 4:
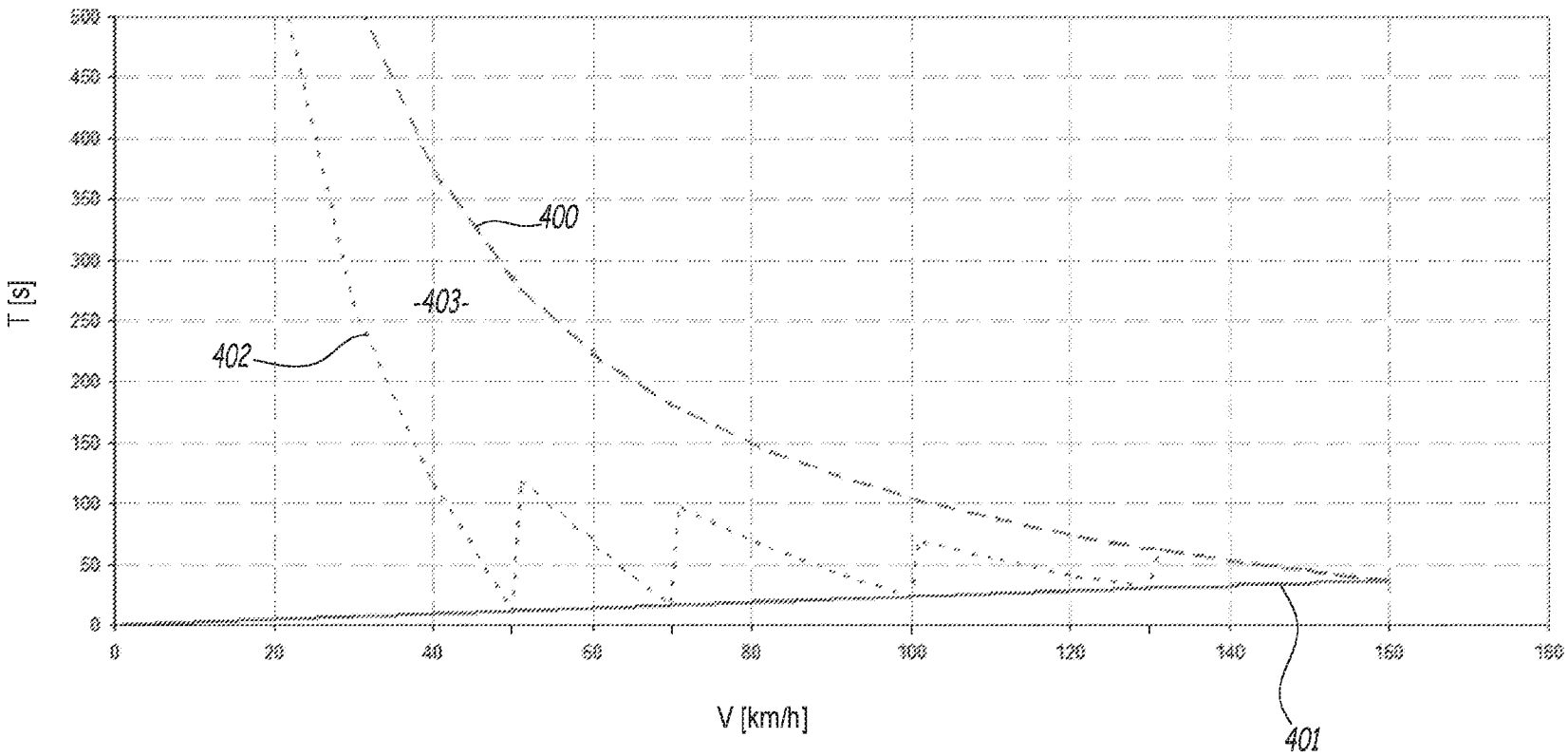
FIG. 4 illustrates the evolution, as a function of the train's speed, of several values of a level crossing protection time as calculated by the interlocking facility of FIGS. 1 and 2.

FIG. 4 illustrates the evolution, computed theoretically for each example of FIG. 3, of protection time T, in seconds, as a function of speed V, in kilometers per hour. In these examples, the maximum value of speed V is equal to 160 km/h.

Curve 300 illustrates an example of waiting time $t_D$ according to state of the art, in which waiting time $t_D$ is a unique value, for example 45 seconds, and remains the same whatever is the value of speed V. The corresponding protection time T is illustrated by curve 400 on FIG. 4. A drawback of this example is that protection time T can only be optimized for a given speed V, for a given distance between activation point 43 and level crossing 4. This is not practical, because trains running on railway tracks 10 do not always have the same speed. For example, if train 2 drives slowly, for example lower than 60 km/h, it needs a longer time to reach point 44 than a faster-running train. However, due to the constant value of waiting time $t_D$, interlocking 5 commands the closure of protection system 41 after this waiting time $t_D$, regardless of the exact position of train 2. By the time protection system 41 is closed, train 2 is still far away from point 44, and so protection system 41 remains the protected state for much longer than necessary. On the other hand, if the constant value of waiting time $t_D$ was increased and/or activation point 43 was placed closer to level crossing 4, slow trains would not cause protection system 41 to remain in a protected state for too long, but it would then cause a problem for faster trains, because in the event that protection system 41 incorrectly remains in the unprotected state due to a technical failure, faster trains would not have enough time to brake and come to a halt before point 44.

Curve 301 illustrates another example of reference data, noted reference data 301, in which waiting time $t_D$ varies continuously as a function of speed V for all possible values of speed V. Reference data 301 is calculated as a function of braking capabilities of trains 2 for each value of speed V. More precisely, for each value of speed V, a corresponding value of waiting time $t_D$ is computed, as a function of expected braking time of a train representative of train 2 and driving at a constant speed of value V.

Figure 7:
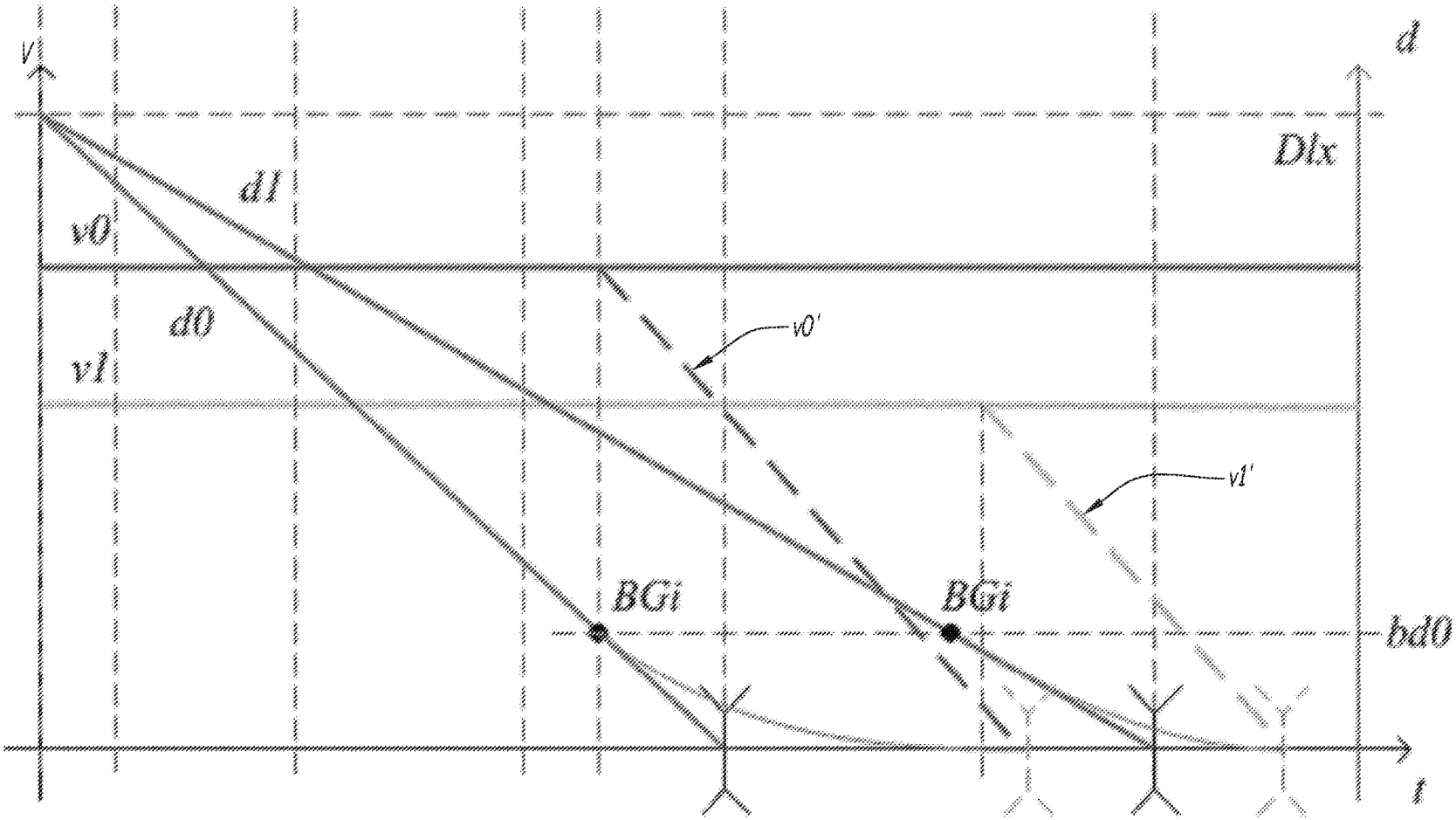
FIG. 7 illustrates schematically speed values intervals used to calculate the level crossing protection time of FIG. 4.

An example of calculating the waiting time $t_D$ of curve 301 is now described. FIG. 7 is the evolution of the speed V and distance d run by the train 2 as function of time t for a given span In of speed values, used to calculate the corresponding waiting time $t_D$. The curve "d0" illustrates the evolution of the distance d in a first example where train 2 runs at a speed V0 in a first span of speed values. Similarly, curve <<d1>> illustrates the evolution of the distance d in a second example where train 2 runs at speed v1 in a second span of speed values. The portions <<v0'>> and <<v1'>> of curves v0 and v1, respectively denote the decrease of speed V after initiating a braking at point BGi. In FIG. 7, <<bd0>> is the braking distance at maximum speed and Dlx is the distance from the activation point 43 to the point 44. The index 0 indicates the maximum speed of the speed interval while the index x indicates any speed belonging to the same speed interval. For each curve d0 or d1, BGi represents the point where the train starts to brake in order to reach the level crossing 4 with speed of 0 kilometers per hour.

The distance run by the train from the activation point 43 is the sum of the following distances:

the distance $d_{IXL}$ run during the interlocking processing time $t_{IXL}$, the distance $d_d$ run during the waiting time $t_D$ introduced, the distance $d_w$ run during the level crossing activation time $t_w$, plus the remaining distance $d_r$ during a remaining time $t_r$.

Therefore, distance Dlx can be expressed as follows:

$$Dlx_0 = Dlx = d_{IXL} + d_d + d_w + d_r$$

The remaining time $t_r$ can be calculated as follows:

$$t_r = \frac{d_r}{v} = \frac{Dlx - d_{IXL} - d_d - d_w}{v} = \frac{Dlx}{v} - t_{IXL} - t_d - t_w$$

Taken Dlx, $t_{IXL}$, $t_d$, and $t_w$ as constant, the remaining $t_r$ is calculated so as to minimize:

$$\frac{\partial t_r}{\partial v} = -\frac{Dlx}{v^2} = 0$$

The previous function has not local maxima or minima, so it is assumed here that the train does not brake or change its speed significantly, for example. the train must keep its speed as high as possible.

The calculation of the maximum value of a speed interval is as follows to build curve 301:

For any span of speed values indexed by x=0, 1, . . . , then speed $V_x$ in this span is calculated as follows:

$$V_x = \frac{Dlx}{t_{IXL} + t_{dx} + t_w + t_{rx}}$$

Thus, the minimum value of remaining time $t_r$ for this span, noted $t_{r\,x\,min}$, is calculated as follows, where "Max( )" denotes the maximum function:

$$t_{rx\,min} = \mathrm{Max}\left(\frac{bd_x}{v_x} + t_{IXL}, t_c\right)$$

$$t_{dx} = \frac{Dlx}{v_x} - t_{IXL} - t_w - t_{rxmin}$$

One defines as predefined parameters "$t_c$" as a required minimum time during which the level crossing is protected and "$K_c$" as the allowed span of the level crossing protection time.

If $t_{r\,x\,min}$ is equal to $t_C$, then BGi point is set at a distance from point 43 equal to $d_{c\,x}$, where $d_c$ is the corresponding distance run by the train during the time $t_c$ and is calculated as follows, here for the span indexed by index "x":

$$d_{c\,x} = Dlx - (t_{IXL} + t_{d\,x} + t_w + t_c)V_x$$

Otherwise, BGi point is set at a distance from point 43 equal to $bd_x$ distance.

The calculation of the minimum value of a speed interval is then as follows:

$$V_{x+1} = \frac{Dlx}{t_{IXL} + t_{dx} + t_w + t_c + K_c}$$

And ensuring that, as a boundary condition, that the minimum speed for the n-th span is equal to the maximum speed for the n+1-th span.

The corresponding protection time T is illustrated as curve 401 on FIG. 4.

This partially overcomes drawbacks of the example of curve 300. By taking account of the train's speed V, protection system 41 does not need to remain closed longer than necessary, as shown by curve 401. If train 2 is running slowly, waiting time $t_D$ is higher and interlocking 5 waits longer before commanding the protection system 41. When protection system 41 is effectively in the protected state, train 2 is closer to point 44 than it would have been if selected waiting time $t_D$ remained constant and did not depend on speed V. However, even if the corresponding protection time T is theoretically lower, reference data 301 has the drawback that waiting time $t_D$ varies exponentially as V decreases towards zero, which is not possible to implement in practice. Another drawback is that an incorrect waiting time $t_D$ is selected in case of a measurement error of speed V. For example, at speed value V equal to 60 km/h, a measurement error of ±10% of speed V may yield an error of ±20 seconds in the determination of waiting time $t_D$.

Curve 302 illustrates a preferred example of reference data, noted reference data 302, in which waiting time $t_D$ varies as a function of speed V. Reference data 302 comprises a plurality of distinct speed value intervals. Each interval is associated to a constant waiting time $t_D$ value. For example, reference data 302 is a step function linking waiting time $t_D$ as a function of speed value V. Preferably, reference data 302 is obtained from reference data 301, by discretizing reference data 301 into a finite number of intervals. The number of intervals of reference data 302 is higher or equal than one. Preferably, this number is lower than ten. Nonetheless, the method imposes no limit in the number of intervals of reference.

Thanks to reference data 302, waiting time $t_D$ value can be constrained at low speeds within predetermined bounds. Another advantage is that the determination of waiting time $t_D$ is more robust in case of a measurement error of speed V. In this example, curve 302 comprises five consecutive intervals I1, I2, I3, I4 and I5, each associated to a different waiting time $t_D$ value.

The corresponding protection time T is illustrated as curve 402 on FIG. 4. On FIG. 4, zone 403 illustrates the difference between the protection time T of curves 400 and 402. For example, at a speed of 60 km/h, the protection time of curve 402 is equal to 60 seconds, which is lower than the protection time of curve 400 equal to 220 seconds.

Thanks to the invention, protection time T is reduced without compromising the safety of level crossing 4.

Figure 5:
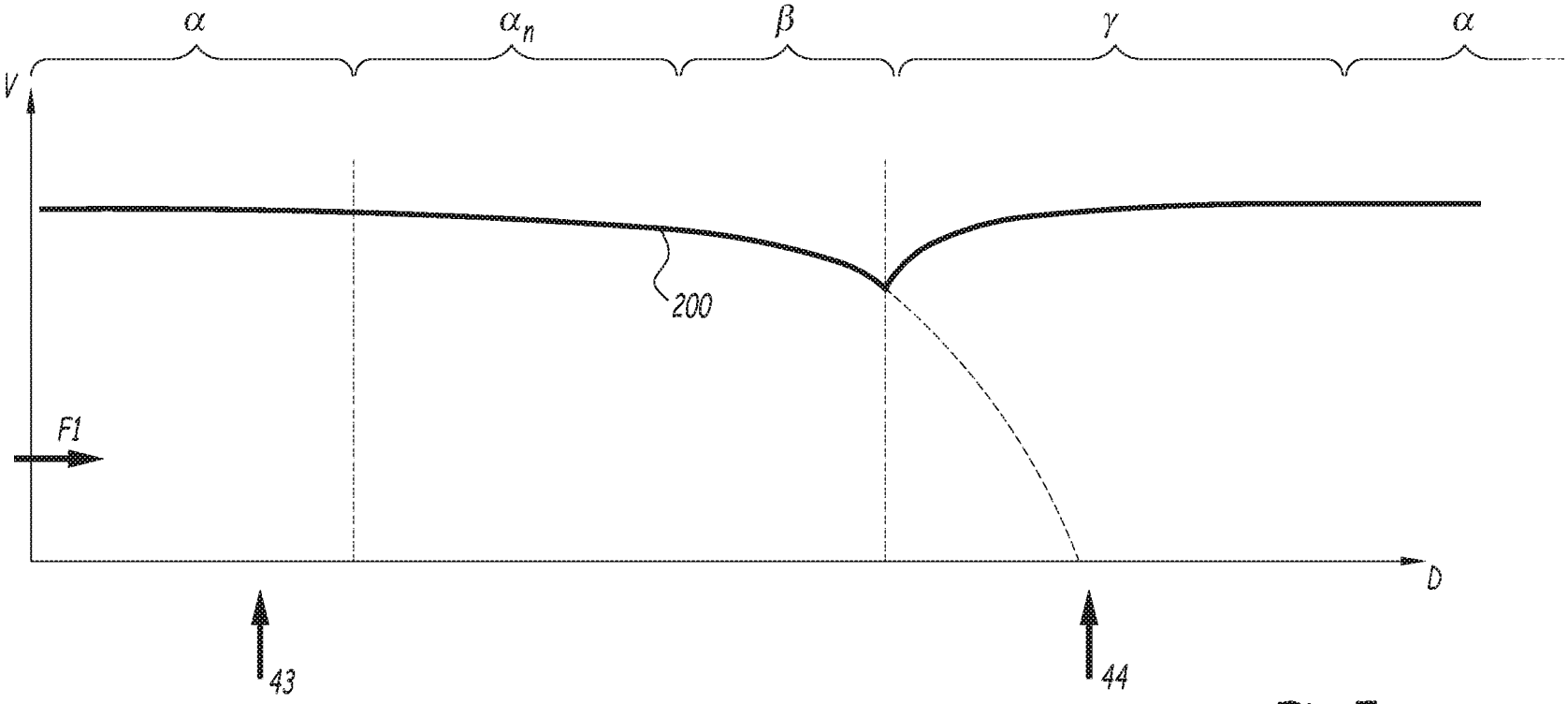
FIG. 5 illustrate schematically different states of a railway signal associated to the level crossing of FIG. 1.

FIG. 5 illustrates different states of signal S generated and sent by interlocking 5 and transmitted by radio block center 6 to control unit 20. Curve 200 illustrates the maximum authorized speed of train 2 as it approaches level crossing 4 moving in the direction illustrated by arrow F1.

In a first state, signal S is said to be activated, which is noted as a on FIG. 5. In this activated state, train 2 is prohibited from going beyond point 44. For example, when train 2 receives such signal S, the movement authority associated to this train 2 is updated so that it ends at point 44. Control unit 20 automatically adapts the speed V of train 2 to ensure that the train will ahead of point 44. For example, a speed limit is displayed to a driver of said train 2 on a cabin signaling system. A first portion of curve 200 illustrates the diminution of this maximum allowed speed as train 2 approaches point 44. Signal S remains in this first state by default, when no train 2 is present and/or until instructed otherwise.

Optionally, once train 2 is detected by interlocking 5 as having passed activation point 43, signal S is maintained in its first state and is completed by a temporary speed restriction, noted TSR and sent by interlocking 5, to force train 2 to reduce its speed to a first target speed. This is noted as $\alpha_n$ on FIG. 5. Optionally, additional temporary speed restrictions can be sent by interlocking 5 to define additional target speeds, so as to force train 2 to slow down gradually, without having to rely solely on the movement authority. In any case, control unit 20 is configured to take over control of the train's speed to make sure that train 2 stops before point 44 even if no temporary speed restriction is sent. Such temporary speed restrictions are preferably used with ERTMS Level 2 signaling systems.

In a second state, signal S allows train 2 to proceed conditionally across level crossing 4. This is illustrated as β on FIG. 5. This second state is usually set once interlocking 5 has sent an instruction commanding the switching of protection system 41 into the protected state, but that interlocking 5 has not yet received confirmation that protection system 41 has finished switching into said protected state.

In a third state, signal S allows train 2 to proceed unconditionally across level crossing 4. Said signal S is also said to be "deactivated" or "lifted". This is illustrated as γ, on FIG. 5. The corresponding movement authority of train 2 is updated and its end is moved further than point 44. For example, this occurs once interlocking 5 has detected that the protection system 41 has fully commuted into the protected state.

Once train 2 has successfully passed beyond level crossing 4, signal S is restored to its first state.

Figure 6:
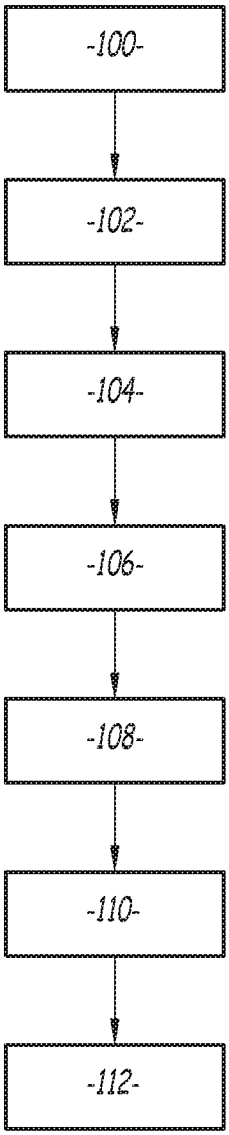
FIG. 6 is a flow chart of a method for commanding the level crossing protection system of FIGS. 1 and 2.

An embodiment of a method for commanding protection system 41 is now described in reference to the illustrative flow chart of FIG. 6.

Initially, during a step 100, railway signal S is activated into the restricted state by interlocking 5. Protection system 41 is initially in the unprotected state. Train 2 moves along railway track 10 towards level crossing 4. Then, train 2 arrives at activation point 43 and passes said activation point 43.

During a step 102, interlocking 5 detects train 2, with the aid of track circuit 8. In practice, this detection is not immediate, due to the time required for communication between interlocking 5 and track circuit 8 and due to the computation time required by calculator 50. In practice, however, this time is quite small, usually lower than one second. Interlocking facility 5 then automatically measures the train speed V, here using track circuit 8 on which train 2 is located. Optionally, a temporary speed restriction may be sent by interlocking 5 to train 2.

During a step 104, calculator 50 acquires said measured speed value V and automatically calculates waiting time $t_D$ as a function of measured speed V. In this example, this calculation comprises the acquisition of reference data 302 by calculator 50 and the comparison of measured speed value V with the predefined speed value intervals of data set 302. A speed value interval is said to be corresponding to measured value V if said speed value V belongs to said interval value. For example, the measured speed value V is equal to 40 km/h. In the example of FIG. 3, calculator 50 identifies interval $I_2$ as being the corresponding speed value interval. The corresponding predefined waiting time $t_D$ associated to interval $I_2$ is automatically acquired by calculator 50, for example from a database. Here, this waiting time is equal to 200 seconds.

During a step 106, calculator 50 automatically waits until expiration of the calculated waiting time $t_D$ before sending a command to switch protection system 41 into its protected state. In theory, waiting time $t_D$ is counted from the moment interlocking 5 detects train 2 as having passed point 43. In practice, one has to take into account the processing time required for implementing step 104 and 102. However, this processing time is small and negligible compared to waiting time $t_D$.

Only once said waiting time has expired, then during a step 108, calculator 50 issues a command to protection system 41, in order to commute said protection system 41 into its protected state. Upon receiving said order, protection system 41 begins switching into the protected state. The time required for protection system to switch during normal operation from its unprotected state to its protected state is called "warning time". For example, safety regulations may require that flashing lights of protection system 41 are activated for a certain amount of time before barriers begin to close. Barriers 42 may also require some time to move. For example, warning time is equal to ten seconds or, preferably, to thirty seconds.

During a further step 110, calculator 50 queries the state of protection system 41, in order to detect whether said protection system 41 has successfully switched into the protected state. Preferably, this querying step is performed once a delay longer than the warning time associated to protection system 41 has elapsed since sending the command during step 108.

If protection system 41 is found to have commuted to the protected state, then railway signal S is deactivated. At his stage of the method, train 2 is allowed to drive beyond point 44. If control unit 20 had begun to reduce the speed of train 2 because of signal S, it may cease to do so and cause train 2 to accelerate again.

Otherwise, if protection system 41 is detected as not having successfully commuted into the protected state, for example due to a technical failure, then railway signal S is maintained in the activated state, so as to prevent train 2 from going beyond point 44. In that case, train 2 stops ahead of point 44. For example, train 2 may then nonetheless pass point 44 if it is allowed to do so by an agent of interlocking 5, according to preset standard operating procedures of system 1.

Figure 8:
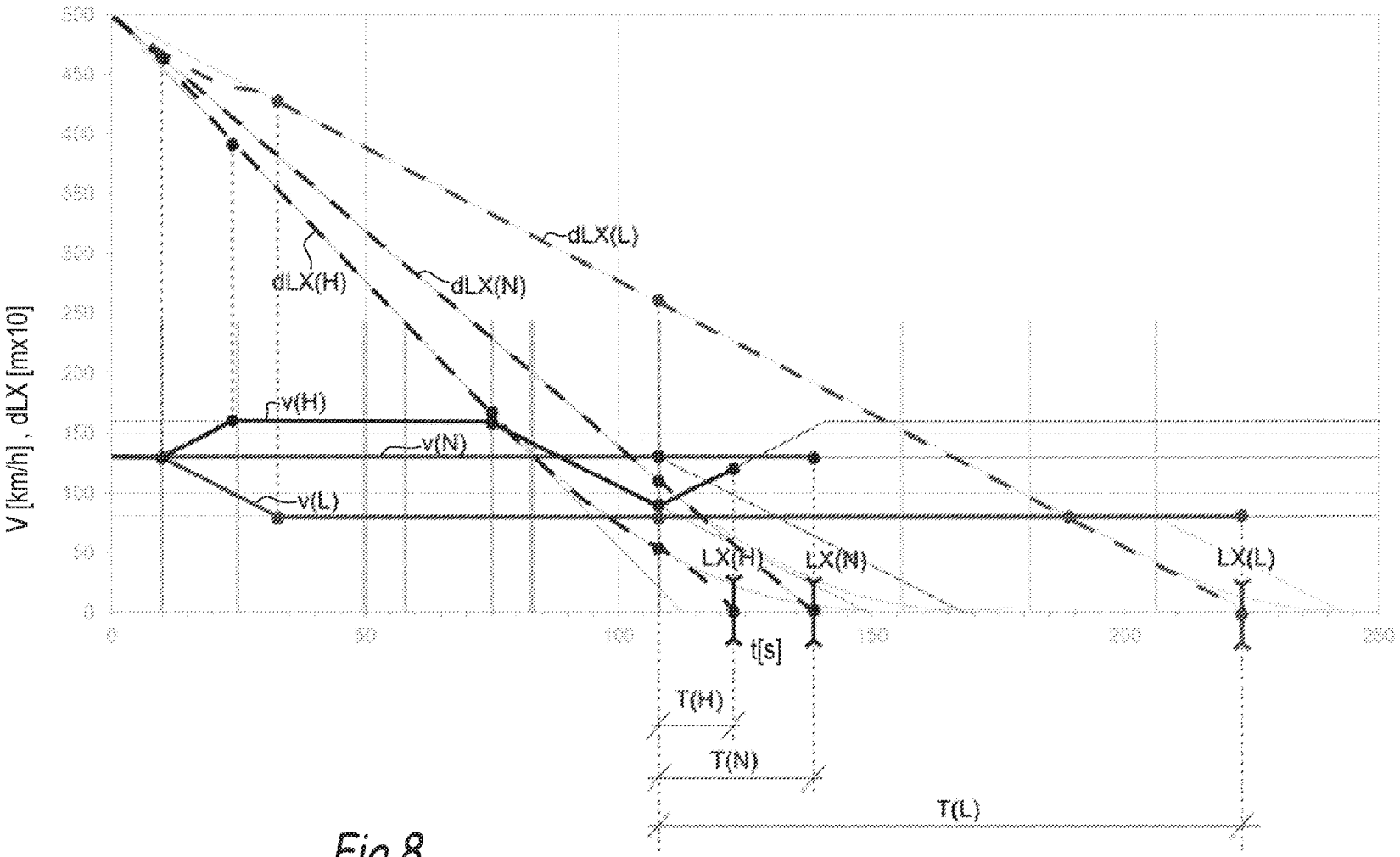
FIG. 8 illustrates the impact, on the level crossing waiting time, of a variation of the train's speed.

A main advantage of the system is that a change of the speed of train 2 has no impact in the safety of the system, as an update of the Movement Authority sent by interlocking 5 shall take place only if the protection status of the level crossing changes, with the side effect of slightly augmenting or decreasing the level crossing protection time, as shown in FIG. 8, illustrating a comparison between a nominal situation with a first example of a train running at a lower speed and a second example of a train running at a higher speed.

On FIG. 8, the curves v(N), v(L) and v(H) illustrate the speed of train 2 as a function of time t, respectively for the nominal situation and for the first and second examples. Time t is counted from the instant when train 2 is detected at activation point 43. The curves dLX(N), dLX(L) and dLX(H) illustrate, on the same FIG. 8, the distance between point 44 and train 2 as a function of time, respectively for the nominal situation and for the first and second examples. This distance is noted dLX in the general case. LX(N), LX(L) and LX(H) denote the respective nominal time of train 2 in the nominal situation and in the first example and second example.

More precisely, in the first example, train 2 slows down after passing activation point 43. This is illustrated on FIG. 8 as a decrease of v(L) after the instant equal to 10 seconds. In the second example, train 2 accelerates after passing activation point 43. This is illustrated on FIG. 8 as an increase of v(H) after the instant equal to 10 seconds.

T(N), T(L) and T(H) denote the protection time of level crossing 4 respectively in the nominal situation, in the first example and the second example.

Finally, during a step 112, if protection system 41 is found to have commuted to the protected state and railway signal S is deactivated, then train 2 passes point 44 and passes across level crossing 4. Once train 2 has passed level crossing 4, calculator 50 commands protection system 41 into returning to its unprotected state. For example, calculator 50 uses track circuits 8 to detect that train 2 has moved beyond level crossing 4. Signal S is then returned to the active state by interlocking 5.

In this illustrative example, only one railway track 10 is described. In another embodiment, system 1 may comprise a railway line comprising two or more distinct railways tracks 10. In this case, an activation point 43 is placed on each railway track. Activation point 43 is placed on the side of level crossing 4 on which trains 2 are normally arriving. If railway track 10 is configured to allow trains to run in both directions, then an activation point 43 is placed on each side of level crossing 4. System 1 or system 1' is then adapted correspondingly.

In this description, only one protection system 41 is described. However, interlocking 5 may command independently a plurality of level crossing protection systems, each analogous to protection system 41, for a plurality of level crossings 4.

The embodiments described above may be combined to generate new embodiments of the invention.

What is claimed is:

1. A method for commanding a railway level crossing protection system, said protection system equipping a level crossing between a railway track and a road and being able to switch selectively between a protected state, in which road vehicles on said road are prohibited from crossing the railway track, and an unprotected state, in which said road vehicles may cross the railway track, the level crossing protection system initially being in the unprotected state, this method comprising steps of automatically:

a) activating a railway signal preventing a train from driving beyond the level crossing, b) detecting an incoming train approaching the level crossing and measuring a speed of said incoming train, c) calculating a waiting time, as a function of the train's measured speed;

d) waiting until expiration of the calculated waiting time and, once said waiting time has expired, sending an order to switch the level crossing protection system into the protected state; and e) querying the state of the level crossing protection system and:

if said level crossing protection system is found to have commuted into the protected state, deactivating said railway signal, thus allowing the train to drive beyond the level crossing, and otherwise;

if said level crossing protection system is found to be still in the unprotected state, maintaining said railway signal in the activated state;

wherein the calculation of the waiting time comprises:

acquiring reference data comprising a plurality of speed value intervals each associated to a predefined waiting time value;

selecting the speed value interval corresponding to the measured speed value; and selecting the predefined waiting time value associated to the selected speed value interval.

2. The method according to claim 1, wherein the number of speed values intervals of the reference data is comprised between 2 and 50.

3. The method according to claim 1, wherein the deactivation of the railway signal comprises updating a Movement Authority of the train by moving the end point of the Movement Authority beyond the level crossing.

4. The method according to claim 1, wherein the railway signal is according to ETCS Level 2 specifications, said railway signal being transmitted to the train using a radio block center.

5. The method according to claim 4, wherein it includes further, during step b), after detecting the train, sending a temporary speed restriction to the detected incoming train.

6. The method according to claim 1, wherein the railway signal is according to ETCS Level 1 specifications, said railway signal being transmitted to the train using a beacon through a lineside encoder unit or a radio-infill device.

7. A data storage unit comprising instructions for implementing the method according to claim 1 when said instructions are executed by a data processing unit.

8. A data processing unit for an electronic calculator of a railway interlocking facility configured to command a railway level crossing protection system equipping a level crossing between a railway track and a road, said protection system being able to switch selectively between a protected state, in which road vehicles on said road are prohibited from crossing the railway track, and an unprotected state, in which said road vehicles may cross the railway track, the level crossing protection system initially being in the unprotected state, said calculator being programmed to:

a) activate a railway signal preventing a train from driving beyond the level crossing, b) detect an incoming train approaching the level crossing and measuring a speed of said incoming train, c) calculate a waiting time, as a function of the train's measured speed;

d) wait until expiration of the calculated waiting time and, once said waiting time expires, sending an order to commute the level crossing protection system into the protected state;

e) query the state of the level crossing protection system and:

if said level crossing protection system is found to have commuted into the protected state, deactivate said railway signal, thus allowing the train to drive beyond the level crossing; and if said level crossing protection system is found to be still in the unprotected state, maintain said railway signal in the activated state;

wherein said data processing unit is further programmed to, during step c) of calculation of the waiting time:

acquire reference data comprising a plurality of speed value intervals each associated to a predefined waiting time value;

select the speed value interval corresponding to the measured speed value; and select the predefined waiting time value associated to the selected speed value interval.

9. A railway interlocking facility, adapted to command a level crossing protection system, wherein said railway interlocking facility comprises the data processing unit of claim 8 in order to command said level crossing protection system.

* * * * *